United States Patent [19]

Shirley

[11] Patent Number: 4,934,705

[45] Date of Patent: Jun. 19, 1990

[54] GOLF COURSE PLAYING APPARATUS

[75] Inventor: Joe Shirley, W. Columbia, S.C.

[73] Assignee: American Communication Services, Inc., Raleigh, N.C.

[21] Appl. No.: 332,585

[22] Filed: Apr. 3, 1989

[51] Int. Cl.[5] ..... A63B 67/02; A63B 69/36

[52] U.S. Cl. ..... 273/176 R; 273/176 L; 273/DIG. 28; 273/32 H

[58] Field of Search ..... 273/32 H, DIG. 28, 176 L, 273/176 FA, 176 R, 176 A, 176 AB, 35 B, 176 AA

[56] References Cited

U.S. PATENT DOCUMENTS

| | | | |
|---|---|---|---|
| 1,832,947 | 11/1931 | Sears et al. | 273/32 H |
| 3,685,168 | 8/1972 | Reitz | 273/32 H |
| 4,005,261 | 1/1977 | Sato et al. | 273/183 R |
| 4,160,942 | 7/1979 | Lynch et al. | 273/183 R |
| 4,192,510 | 3/1980 | Miller | 273/DIG. 28 |
| 4,666,175 | 5/1987 | Bodine et al. | 273/32 H |

FOREIGN PATENT DOCUMENTS

| | | | |
|---|---|---|---|
| 2155796 | 10/1985 | United Kingdom | 273/DIG. 28 |
| 2157925 | 10/1985 | United Kingdom | 273/DIG. 28 |

*Primary Examiner*—George J. Marlo

*Attorney, Agent, or Firm*—Bailey & Hardaway

[57] ABSTRACT

A multi-holed golf course having fariways, greens and tee boxes comprising a television monitor located on the tee box;

a videocassette player;

a videocassette within said videocassette player having video images stored thereon including images of the golf hole on which the apparatus is located; and apparatus to initiate play of the videocassette player so as to display video images of said golf hole upon said television monitor. Electrical power may be provided by a battery connected to a battery charger operated by solar panels located on top of a cabinet which contains the television monitor and videocassette player.

4 Claims, 1 Drawing Sheet

GOLF COURSE PLAYING APPARATUS

BACKGROUND OF THE INVENTION

This invention relates generally to the art of strategy golf and more particularly to a novel apparatus involving the use of a television monitor and a videocassette recorder.

Various prior art devices have existed to assist in the participation in the game of golf.

U.S. Pat. No. 4,666,175 to Bodine, et al. discloses a golf course playing apparatus wherein statistical information in the form of a booklet including the ability to feed such information to a computer to maintain and compilation of information therein.

U.S. Pat. No. 4,160,942 to Lynch, et al. discloses a complex trajectory presentation system to aid in assisting the golfer to predict the path travel of a golf ball.

U.S. Pat. No. 4,005,261 to Sato, et al. discloses a storage image device which produces a composite video signal which when repeatedly applied to a video monitor provides a composite-still picture of a moving object such as a golf ball at various intervals during a course of flight.

U.S. Pat. No. 1,832,947 to Sears, et al. discloses a marker for use on a golf course to indicate a tee location and further provides data regarding the hole on which the tee is located.

While these prior art devices all provide assistance in the game of golf, the nature of the game lends itself to continued improvements and refinements so as to enhance its recreational value.

SUMMARY OF THE INVENTION

It is thus an object of this invention to provide a novel apparatus to assist in the strategy of golfing participation.

It is a further object of this invention to provide such an apparatus which simultaneously provides information while the golfer views with his own senses the hole about to be played.

It is a yet further and more particular object of this invention to provide an apparatus which may be located upon a golf course for operation to provide such information in all weather conditions.

These as well as other objects are accomplished by a golf course information apparatus for a multi-holed golf course having fairways, greens and tee boxes comprising:

a television monitor located on the tee box;

a videocassette player;

a videocassette within said videocassette player having video images stored thereon including images of the golf hole on which the apparatus is located; and means to initiate play of said videocassette player so as to display video images of said golf hole upon said television monitor.

DETAILED DESCRIPTION

In accordance with this invention it has been found that the game of golf may be greatly enhanced by the apparatus to be described within. The apparatus provides information in a video form on the tee box of each hole of a golf course, information related to the hole about to be played. The apparatus may contain further information with regard to statistics regarding the hole in an audio format accompanying the video presentation. Various other information may also be available regarding the course as a whole as well as advertising material. Such greatly enhances the enjoyment of the game of golf in that it is played with greater information by the participant. Various other advantages and features will become apparent from a reading of the following description which is given with reference to the various figures of drawing.

Figure 1:
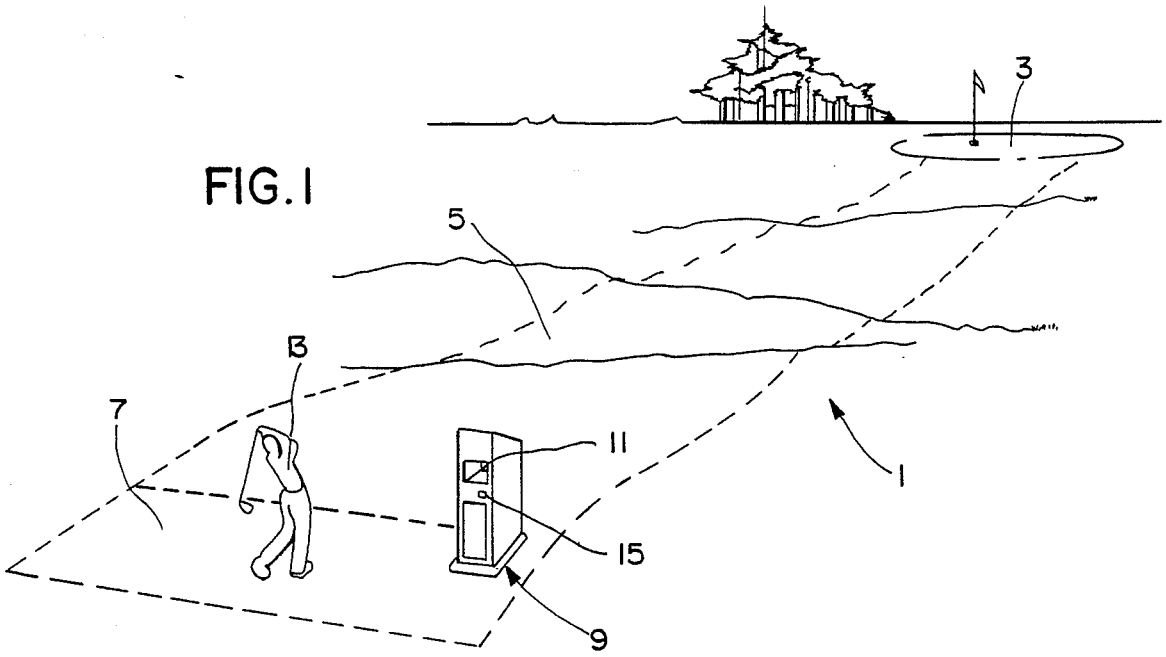
FIG. 1 of the drawings illustrates in perspective view a golf course setting with the apparatus of this invention located thereon.

FIG. 1 of the drawings illustrates generally a hole of a golf course 1 having a green 3, a fairway 5 and a tee box 7. Located on the tee box 7 is the apparatus 9 of this invention. The apparatus 9 has a video monitor 11 viewable by a golfer 13 prior to playing the particular hole, generally illustrated as 1. The view monitor 11 is associated with a videocassette player not illustrated in FIG. 1 but which will be further described below such that by activation as by means 15 video information as well as audio information provided by the apparatus 9 so as to impart greater information to the golfer 13 than he had previously had regarding the hole about to be played. Such information includes statistical information regarding the hole in terms of distance, hazards, appropriate clubs to utilize, slope of the green, etc. The information may further include as well as a general view of the hole, aerial views, expected lines and particular clubs to utilize. The history of the hole may also be included; particularly lowest scores achieved on the hole, the golfer who did it and the date on which it was done. The video information may also include information regarding the golf course as a whole, upcoming events at the golf course as well as general advertising material. The apparatus 9 will now be further described.

Figure 2:
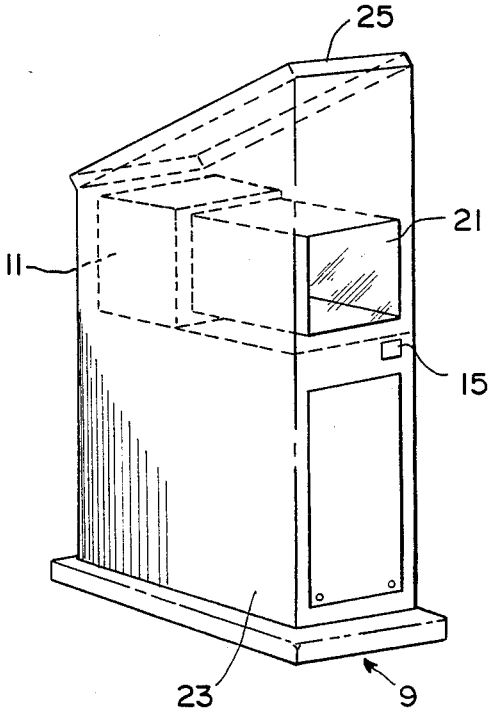
FIG. 2 of the drawings illustrates a cabinet structure in accordance with the apparatus of this invention in perspective and partial phantom view.

Preferably, the apparatus 9 is totally self-contained so as to require no separate electrical connections throughout a golf course. It is, however, understood that the apparatus may utilize separate electrical connections and still be within the scope of this invention. The apparatus 9 is generally illustrated in FIG. 2 where the monitor 11 is visible through a transparent weather-tight screen 21 located within cabinet 23. The cabinet 23 provides housing for the monitor and for the various components to be further described below with regard to FIG. 3.

An important aspect, however, illustrated in FIG. 2 is the location of solar panels 25 which provide the power required for operation of the monitor 21 and videocassette player contained within cabinet 9.

Figure 3:
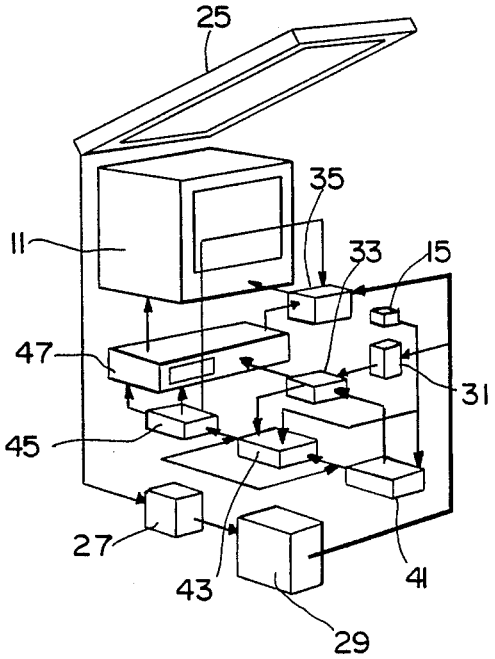
FIG. 3 of the drawings illustrates in a block diagram the components within the apparatus of this invention.

FIG. 3 of the drawings illustrates the various components housed within cabinet 9. As illustrated in FIG. 3, means for activation of the device as at 15 which is located on the exterior of the cabinet as shown in FIGS. 1 and 2 for activation by a golfer requiring information.

Preferably solar panels 25 provide power which operate a battery charger 27 to provide storage of energy in a battery source such as 29. It is understood that if an external source of power is utilized, this aspect of the invention would be replaced by a simple electrical outlet. The remaining components are the standard components associated with a VCR and monitor with the exception of the videocassette containing information of both a video and audio nature. There is a thus a voltage regulator 31 associated with a videocassette power latch 33 and the monitor power latch 35, both of which are activated by means 15 which operate through primary trigger and lockout 41 and secondary trigger 43 which will initiate a start-up sequencer 45 which will automatically begin the sequence and rewind the videocassette upon completion of the sequence. The videocassette player 47 thus communicates directly with monitor 11 to provide the sequence of information provided.

It is thus seen that the game of golf is greatly enhanced in accordance with the teachings of this invention in that there is provided an apparatus to be available in every tee box to provide substantial information regarding the hole, the golf course as a whole and perhaps even the community as a whole.

As the above description is exemplary in nature, many variations will become apparent to those of skill in the art. Such variations, however, are embodied within the spirit and scope of this invention as defined by the following appended claims.

What is claimed is:

1. In a multi-holed golf course having fairways, greens and tee boxes the improvement comprising:

a television monitor located on the tee box;

a videocassette player;

a videocassette within said videocassette player having video images stored thereon including video images the golf hole and strategy information concerning the hole on which the apparatus is located; and means to initiate play of said videocassette player so as to display said video images of said golf hole upon said television monitor.

2. The apparatus in accordance with claim 1 further including a solar energy array, a battery charger, and a battery source to operate said monitor and videocassette player.

3. The apparatus in accordance with claim 2 further comprising a cabinet to house said monitor and said videocassette player and wherein said cabinet has a top portion and said solar array is displayed upon said top portion of said cabinet.

4. A multi-holed golf course having fairways, greens and tee boxes comprising:

a television monitor located on said golf course;

a videocassette player;

a videocassette within said videocassette player having video images stored therein including images and relevant strategy information concerning one of the golf holes on said course; and means to initiate play of said videocassette player so as to display the video images of said golf hole upon said television monitor so as to assist the user thereof with the strategy of golf.

* * * * *